United States Patent [19]

Young

[11] Patent Number: 4,535,491

[45] Date of Patent: Aug. 20, 1985

[54] COMMODE ANTI-SPLASH DEVICE AND METHOD

[76] Inventor: Scott C. Young, 203-B Wilson St., Greensboro, N.C. 27401

[21] Appl. No.: 602,528

[22] Filed: Apr. 20, 1984

[51] Int. Cl.[3] ..... E03D 9/08

[52] U.S. Cl. ..... 4/658; 4/300.3

[58] Field of Search ..... 4/658, 542, 300, 301, 4/300.3, 541, DIG. 5, 319, 320, 420; 181/233, 234

[56] References Cited

U.S. PATENT DOCUMENTS

| | | | |
|---|---|---|---|
| 45,315 | 12/1864 | Carr | 4/300.3 X |
| 3,157,888 | 11/1964 | Violette | 4/319 |
| 3,383,710 | 5/1968 | Sumner | 4/300.3 |
| 3,491,379 | 1/1970 | Parrish | 4/420 X |
| 3,585,649 | 6/1971 | Miya | 4/300 |
| 4,040,415 | 8/1977 | Kulisch | 4/542 X |
| 4,075,718 | 2/1978 | Hargraves | 4/300 |
| 4,142,261 | 3/1979 | Johansen | 4/300 |
| 4,170,797 | 10/1979 | Sundberg | 4/300 |
| 4,246,665 | 1/1981 | Albertassi | 4/320 X |
| 4,321,714 | 3/1982 | Takai et al. | 4/300 X |
| 4,420,846 | 12/1983 | Bonner | 4/542 |

FOREIGN PATENT DOCUMENTS

| | | | |
|---|---|---|---|
| 589572 | 12/1959 | Canada | 4/319 |

*Primary Examiner*—Stephen Marcus
*Assistant Examiner*—Leo J. Peters

[57] ABSTRACT

Commode splash and noise is reduced or eliminated by the creation of turbulence in the bowl water. Pressurized water streams or other methods of agitating the bowl water such as by stirring are presented which can be retrofitted to existing commodes.

5 Claims, 4 Drawing Figures

FIG. 1
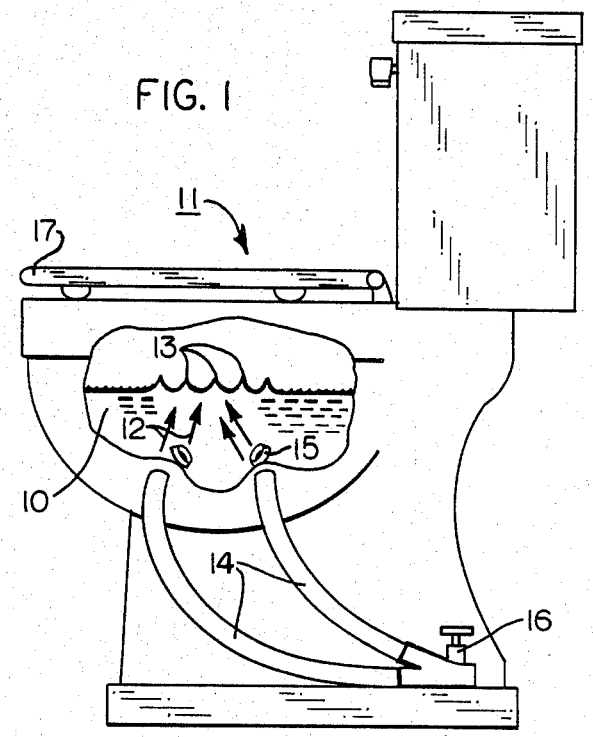
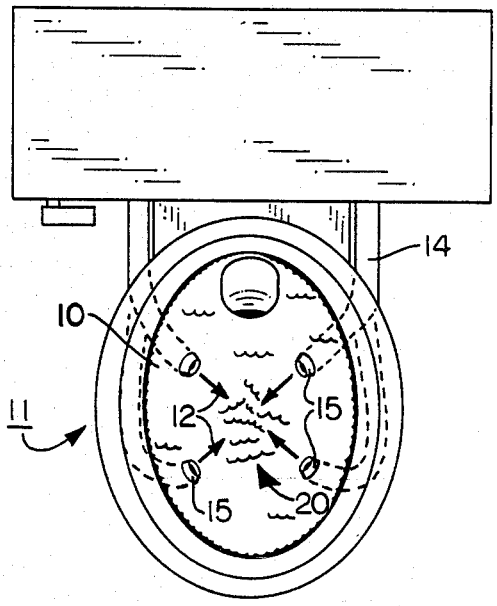
FIG. 2
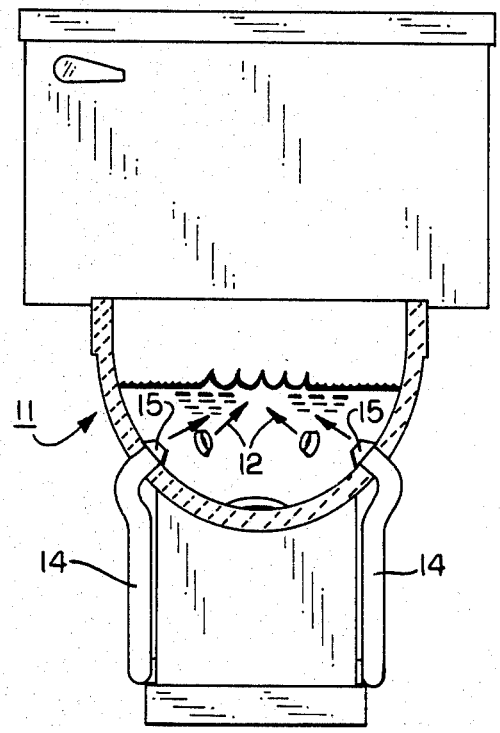
FIG. 3
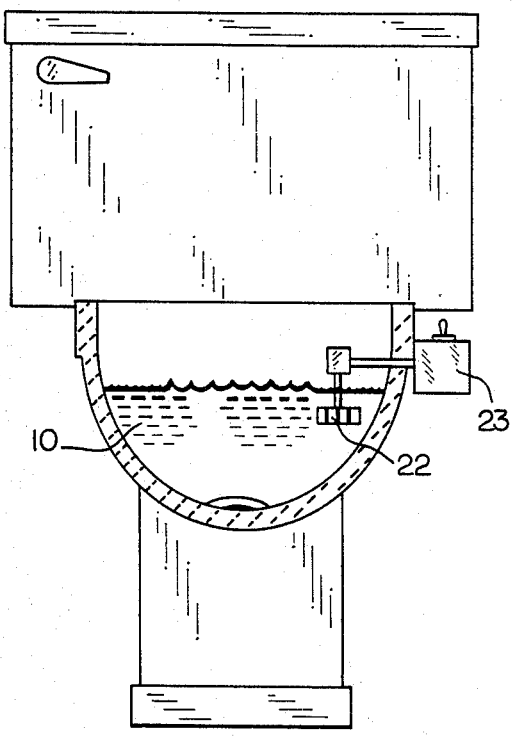
FIG. 4

COMMODE ANTI-SPLASH DEVICE AND METHOD

BACKGROUND OF THE INVENTION

1. Field Of The Invention

This invention relates to an improved anti-splash device for a commode and a method to suppress splash and the accompanying noise.

2. Description Of The Prior Art And Objectives of the Invention

Various attempts in the past have been made to prohibit or reduce noise and splash associated with the deposit of body wastes in toliets with varying degrees or practicality and success. For example U.S. Pat. No. 3,383,710 demonstrates the application of foam to the commode water such as by using a small-bubbled, short-lived foam.

Others have attempted to use screens or baffles such as shown in U.S. Pat. No. 2,931,041 or the Carr Urinal as shown in U.S. Pat. No. 45,315 using flowing water.

Even with the use of foaming agents, foams, splash plates and the like a practical solution to the splash and accompanying noise has not been satisfactorily determined and it is one goal of the present invention to provide a commode anti-splash device and method which will be both economical in cost and practical in application.

It is another objective of the present invention to provide an anti-splash device which will greatly reduce the splash and accompanying noise as human waste is deposited in commodes by creating a turbulence in the bowl water during use.

It is yet another objective of the present invention to provide an anti-splash device which can be retrofitted to existing commodes.

Other objectives and advantages of the present invention will become apparent to those skilled in the art as a more detailed description of the invention is set forth below.

SUMMARY OF THE INVENTION

The aforesaid and other objectives of the invention are accomplished by providing a conventional commode bowl with an agitating means which will provide turbulence to the water. The turbulence or waves thus produced will interfere with any pulsive force such as occurs by a deposit of solid waste materials from above the water contained within the bowl. Splash, and the accompanying noise is thereby greatly reduced as the energy from the falling objects strike the turbulent area thereby dispersing or scattering the kinetic energy.

BRIEF DESCRIPTION OF THE DRAWINGS

FIG. 1 demonstrates a commode with one embodiment of an anti-splash device attached;

FIG. 2 shows a top plan view of the commode as shown in FIG. 1;

FIG. 3 shows a front elevational view with the bowl cut-away;

FIG. 4 demonstrates a cut-away portion of the bowl with another embodiment of the agitating means.

DESCRIPTION OF THE PREFERRED EMBODIMENTS

The preferred commode anti-splash device is shown in FIGS. 1–3 in which a plurality of water supply nozzles are demonstrated within the bowl water for directing streams of water toward the top center of the bowl water to provide turbulence. Also shown is a convenient valve positioned on the nozzle supply lines to adjust the intensity of the streams.

The preferred method for suppressing commode bowl splash and accompanying noise consists of agitating the bowl water by directing four streams of water positioned approximately equal distances apart through the bowl water to provide turbulence thereto during use.

DETAILED DESCRIPTION OF THE DRAWINGS

For a more complete understanding of the device and its method of operation, it has been found that commode bowl water 10 as shown in FIG. 1 if still, will splash and thereby create embarrassing noises as human wastes are deposited therein. It has been found that commode 11 can be modified by agitating bowl water 10 to prevent the splash and the accompanying noises by agitating bowl water 10 by directing streams (demonstrated by arrows 12 in FIG. 1) through the bowl water to provide a turbulence in the form of waves 13. Nozzle supply lines 14 provide water to nozzles 15 and control valve 16 adjusts the velocity of streams 12. As understood, control valve 16 may be placed in a convenient location for the user or can be automatically actuated such as by sitting on seat 17 by appropriate switches and connections (not shown).

As shown in FIG. 2 nozzles 15 are pointed upwardly and towards the center top of bowl water 10 to provide the maximum turbulence in area 20. Streams 12 as shown in FIGS. 1–3 provide the necessary turbulence to interfere with any pulsive force to effectively cancel the kinetic energy of any wastes or particles falling into the system whereby the turbulence disperses the kinetic energy or pulsive force to eliminate the splash and noise. Bowl water 10 is not normally agitated during flushing as is normal at the end of the use of the commode but agitated prior to flushing while the water is contained within the bowl.

Other agitating means, other than water streams 12 will also cause a reduction in the splash and accompanying noise. As shown in FIG. 4 paddle 22 which is driven by motor 20 which may be for example a $\frac{1}{8}$ horse power electric motor will impart waves to the bowl water thus reducing noise and splash.

Various modifications and improvements can be made to the invention as demonstrated herein and the illustrations and examples are for explanatory purposes and are not intended to limit the scope of the invention.

I claim:

1. An anti-splash device for use with a commode having a bowl and a quantity of water for receiving human waste, said water and waste remaining in the bowl until flushed, the anti-splash device comprising: agitating means, said agitating means including a supply nozzle for directing a stream of liquid through the bowl water, said agitating means positioned proximate said bowl for agitating said bowl water to maintain it in a turbulent state to prevent splash and to reduce the noise of the waste contacting the water while the water is contained in the bowl prior to flushing.

2. An anti-splash device as claimed in claim 1 and including a plurality of supply nozzles proximate said bowl.

3. An anti-splash device for use with a commode having a bowl and a quantity of water for receiving human waste, said water and waste remaining in the bowl until flushed, the anti-splash device comprising: agitating means, said agitating means including a paddle, said agitating means positioned proximate said bowl for agitating said bowl water to maintain it in a turbulent state to prevent splash and to reduce the noise of the waste contacting the water while the water is contained in the bowl prior to flushing.

4. A method for suppressing splash and noise during use of a commode bowl having a quantity of water for receiving human waste, said water and waste remaining in the bowl until flushed, the method including the step of: agitating the bowl water sufficiently with a paddle to provide turbulence thereto to effectively cancel the kinetic energy of the waste received by the water prior to flushing.

5. A method for suppressing splash and noise during use of a commode bowl having a quantity of water for receiving human waste, said water and waste remaining in the bowl until flushed, the method including the step of agitating the bowl water sufficiently to provide turbulence to effectively cancel the kinetic energy of the waste received by the water prior to flushing, by passing a stream of liquid through the bowl water.

* * * * *